US008635790B2

(12) United States Patent
Goldberg et al.

(10) Patent No.: US 8,635,790 B2
(45) Date of Patent: Jan. 28, 2014

(54) AMENITIES CASE

(75) Inventors: Moshe Goldberg, Tel Aviv (IL); Ariel Brender, Tel Aviv (IL)

(73) Assignee: M.G.K. Holding Ltd., Tel Aviv (IL)

( * ) Notice: Subject to any disclaimer, the term of this patent is extended or adjusted under 35 U.S.C. 154(b) by 0 days.

(21) Appl. No.: 12/521,401

(22) PCT Filed: Nov. 7, 2007

(86) PCT No.: PCT/IL2007/001351

§ 371 (c)(1),
(2), (4) Date: Jun. 26, 2009

(87) PCT Pub. No.: WO2008/081422

PCT Pub. Date: Jul. 10, 2008

(65) Prior Publication Data

US 2010/0140310 A1 Jun. 10, 2010

(30) Foreign Application Priority Data

Dec. 28, 2006 (IL) ..... 180438

(51) Int. Cl.
*A43B 3/24* (2006.01)

(52) U.S. Cl.
USPC ..... 36/100; 36/9 R; 36/102; 36/112

(58) Field of Classification Search
USPC ..... 206/546, 216, 223, 581, 38, 37, 278, 206/287.1; 36/9 A, 11.5, 100, 9 R
See application file for complete search history.

(56) References Cited

U.S. PATENT DOCUMENTS

| | | | | |
|---|---|---|---|---|
| 1,544,578 | A | 7/1925 | Henderson | |
| 2,823,490 | A * | 2/1958 | Griem | 446/73 |
| 2,943,403 | A | 7/1960 | Meister | |
| 4,571,851 | A | 2/1986 | Yamada | |
| 4,974,730 | A * | 12/1990 | Deruysscher | 206/581 |
| 5,095,924 | A * | 3/1992 | Stanfield | 132/315 |
| 5,265,349 | A * | 11/1993 | Munschy | 36/97 |
| 6,446,361 | B1 * | 9/2002 | Chun | 36/100 |
| D483,562 | S * | 12/2003 | Barton | D3/226 |
| 6,715,220 | B1 | 4/2004 | Isenberg | |
| 7,032,327 | B1 * | 4/2006 | Tartaglia et al. | 36/11.5 |
| 7,376,999 | B2 * | 5/2008 | Haft | 12/142 S |
| 7,735,244 | B1 * | 6/2010 | Ameche | 36/102 |
| 2006/0242862 | A1 * | 11/2006 | Chelani | 36/114 |
| 2006/0248748 | A1 * | 11/2006 | Warren | 36/9 R |

FOREIGN PATENT DOCUMENTS

| | | |
|---|---|---|
| CH | 99877 | 6/1923 |
| GB | 1 463 863 | 2/1977 |

OTHER PUBLICATIONS

Apr. 4, 2008 Search Report issued in International Application No. PCT/IL2007/001351.

* cited by examiner

*Primary Examiner* — David Fidei
*Assistant Examiner* — Raven Collins
(74) *Attorney, Agent, or Firm* — Oliff & Berridge, PLC

(57) ABSTRACT

An article having a primary use associated with an open position thereof, and a secondary use associated with a closed position thereof. The primary use is that of a piece of clothing, and the secondary use is that of a storage container. The article comprises a pouch portion (12) having an opening (20), the pouch constituting, in the open position of the article, a functional portion of said piece of clothing, and, in a the closed position of the article, a storage pocket.

6 Claims, 3 Drawing Sheets

AMENITIES CASE

FIELD OF THE INVENTION

This invention relates to a case and particularly to a case provided for holding a toiletry kit.

BACKGROUND OF THE INVENTION

It is common, especially on commercial airline flights, to provide complimentary toiletry or amenity kits (at times referred to as 'convenience kit') for use by travelers. Such kits may be used also by campers, hikers, etc.

These kits typically include small, single-use items which may be useful during travel, such as socks, hand cream, tooth brush and tooth paste, ear-plugs, etc. In general, each kit is contained within a small pouch or sack.

It is known that the lavatories of an aircraft do not retain their cleanliness throughout the duration of a flight, in particular long flights, and thus entering a lavatory barefooted or wearing socks may be an unpleasant experience. Thus, wearing shoes or slippers is desired.

By necessity, these kits, especially on airlines, are small, and thus the number and nature of the items which may be included therein is limited.

SUMMARY OF THE INVENTION

According to one aspect of the present invention, there is provided an article having a primary use associated with an open position thereof, and a secondary use associated with a closed position thereof, the primary use being that of a piece of clothing, the secondary use being that of a storage container, the article comprising a pouch having a closable opening, the pouch constituting, in the open position of the article, a functional portion of the piece of clothing, and, in a the closed position of the article, a storage pocket.

The piece of clothing may be a slipper, wherein the pouch functions, in the open position of the article, as a vamp thereof.

The pouch may comprise at least one back wall extending beyond the opening, the back wall constituting, in the open position of the article, a sole of the slipper, and, in a the closed position of the article, a closing flap of the storage container.

The article, in its closed position, is configured to receive at least another same article. Said same article is typically stored within the article also at its closed position. For example, the article may be made of flexible material such as fabric.

The article may comprise a securing arrangement. A first part of the securing arrangement is located on the back wall at an end which is farthest from the pouch, and a second part of the securing arrangement is located on the pouch. The first and second parts of the securing arrangement cooperate together for retaining the article in its closed position. The securing arrangement may be one of a hook and pile arrangement, such as sold under the name Velcro®, snaps, buttons and buttonholes, and hooks and eyelets.

A lower surface of the back wall, which constitutes the sole of the slipper when the article is in the open position, may comprise treads, or the sole portion may be made of, or coated with a liquid permeable material.

The article may comprise toiletry items stored within the pouch. The toiletry items may comprise at least one of a pair of socks, toothpaste, a toothbrush, a collapsible toothbrush, a face-wipe, a shaving kit, mouthwash, hand cream, a facemask, a comb, earplugs, etc.

When the toiletry items includes a pair of socks, the article and the socks may comprise cooperating parts of a fastening arrangements correspondingly located such that when a user is wearing the socks and the article as a slipper, the cooperating parts of the fastening arrangements are aligned. The first part of the securing arrangement may constitute one of the parts of the fastening arrangement of the article. The fastening arrangement may be one of a hook and pile arrangement, such as sold under the name Velcro®, snaps, buttons and buttonholes, and hooks and eyelets.

According to another aspect of the present invention, there is provided a kit comprising an article as described above, and at least one toiletry item stored within the pouch. The kit may comprise two of the articles, for example, a first of the articles stored, in its closed position, within a second of the articles, for example, in its pouch. The at least one toiletry item may be stored within the pouch of the first of the articles.

BRIEF DESCRIPTION OF THE DRAWINGS

In order to understand the invention and to see how it may be carried out in practice, an embodiment will now be described, by way of a non-limiting example only, with reference to the accompanying drawings, in which.

DETAILED DESCRIPTION OF EMBODIMENTS

Figure 1A:
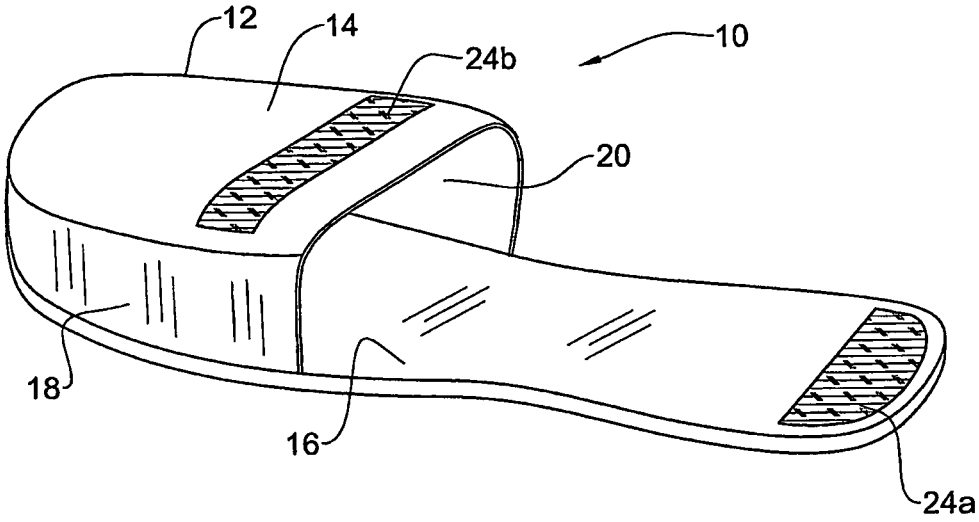
FIG. 1A is a perspective view of an article according to the present invention in an open position.
Figure 1B:
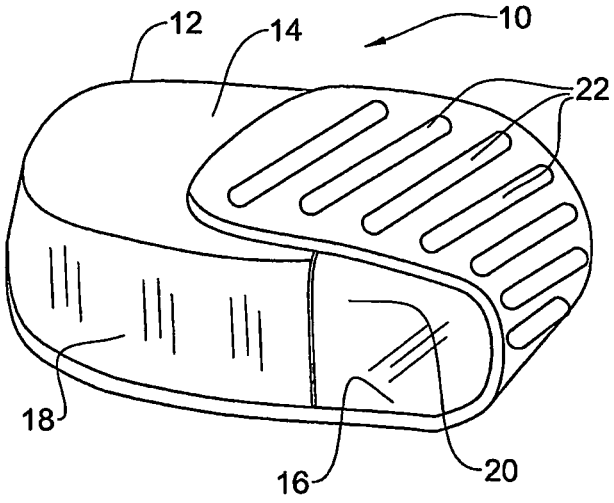
FIG. 1B is a perspective view of the article illustrated in FIG. 1A in a closed position.

FIGS. 1A and 1B illustrate an article, generally indicated at 10, which is readily transformable between an open position, as illustrated in FIG. 1A, and a closed position, as illustrated in FIG. 1B.

The article comprises a pouch portion 12 having an opening designated at 20. The pouch 12 is formed by a top wall 14, a back wall 16, and a side wall 18 therebetween. The opening 20 is defined by edges of the top and side walls 14 and 18, respectively.

The pouch 12 is sized and shaped for receiving various toiletry/convenience articles such as a pair of socks, toothpaste, a toothbrush, a collapsible toothbrush, a face-wipe, a shaving kit, mouthwash, hand cream, a facemask, a comb, earplugs, etc. (not illustrated in the FIGS. 1A and 1B).

In the open position as illustrated in FIG. 1A, the article 10 functions as a slipper, once the convenience articles have been removed from the pouch portion 12. Thus, the pouch 12 constitutes the vamp thereof, and the back wall 16 constitutes the sole thereof. In the closed position (FIG. 1B) the article 10 functions as a storage pouch/container for holding the toiletry items, wherein the back wall 16 constitutes a cover thereof.

The top and side walls 14 and 18 are made of fabric which is flexible yet has sufficient stiffness to maintain the pouch 12 such that the opening 20 remains open when no external force acts thereupon. In addition, an interior liner may be provided. The liner is preferably of a material which offers comfort to a user when the article 10 is being worn as a slipper.

The back wall 16 may comprise an interior shell (not seen), which gives the article its shape in its open and closed positions, and is flexible enough to be easily bent between the two positions. The shell may be made of, e.g., a polyethylene or viscoelastic sheet, or a stiff woven material. The liner is covered with a fabric which is similar or aesthetically complementary to that used to make the top and side walls 14 and 18. Treads 22 (seen in FIG. 1B), for example made from a viscoelastic material, may be provided on the underside of the back wall 18 in order to provide traction to a user when used as a slipper. Alternatively, the bottom face of the back wall 16 may be made of or coated with a liquid impermeable material, or the shell (not seen) may be made of such a material.

According to another embodiment, the article 10 is made of an inexpensive material, such that the article is disposable, such as SMS, or a staple non-woven made with cellulose. The article 10 may then be provided for a single use.

On the upper side of the back wall 16, on the end farthest from the pouch 12, is a first part 24*a* of a securing arrangement (seen in FIG. 1A). A second part 24*b* of the securing arrangement is located on top wall 14 of the pouch 12, on the outer side thereof. Thus, the article 10 can be retained in its closed position. The securing arrangement may be a hook and pile arrangement, such as that sold under the name Velcro®, snaps, buttons and buttonholes, or hooks and eyelets.

Figure 4A:
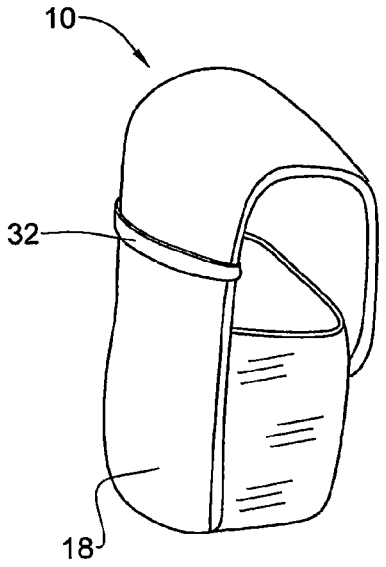
FIG. 4A is a perspective view of the article according to another embodiment, comprising an attachment arrangement.
Figure 4B:
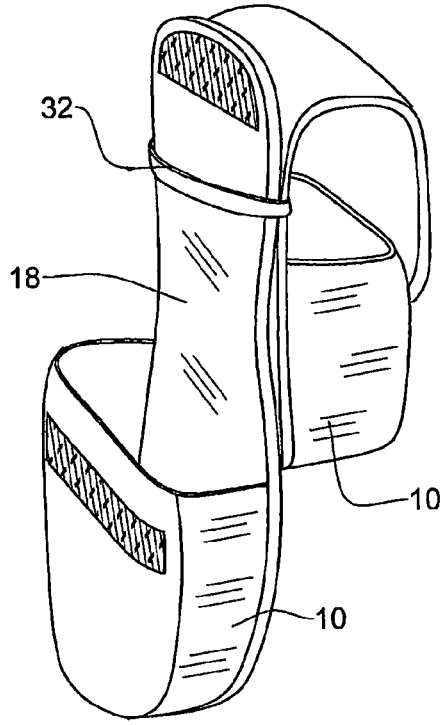
FIG. 4B is a perspective view of the article illustrated in FIG. 4A, with another of the articles partially received within the attachment arrangement.
Figure 4C:
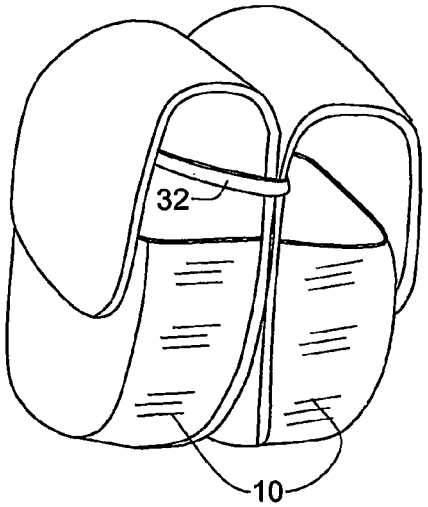
FIG. 4C is a perspective view of the articles illustrated in FIG. 4B, both in their respective closed position, and fully attached via the attachment arrangement.

According to another embodiment, at least one of the articles 10 may be provided with an attachment arrangement adapted to attach two articles to each other. For example, as illustrated in FIG. 4A, a strap 32 may be provided on the underside of the back wall 18. The strap 32 is loose enough to receive therein the back wall 18 of a second one of the articles 10, as illustrated in FIG. 4B. As illustrated in FIG. 4C, the second of the articles is pulled such that it may be closed around the strap 32, thus attaching the two articles 10. Thus, twice the storage capacity may be realized.

According to modifications of this embodiment, the attachment arrangement may be, e.g., a hook and pile arrangement (such as Velcro™), snaps, buttons and buttonholes, hooks and eyelets, etc. When appropriate, each of the articles 10 may comprise corresponding portions of the attachment arrangement.

The article may be provided with toiletry items within the pouch, such as a pair of socks, toothpaste, a toothbrush, a collapsible toothbrush, a face-wipe, a shaving kit, mouthwash, hand cream, a facemask, a comb, and/or earplugs.

Figure 2:
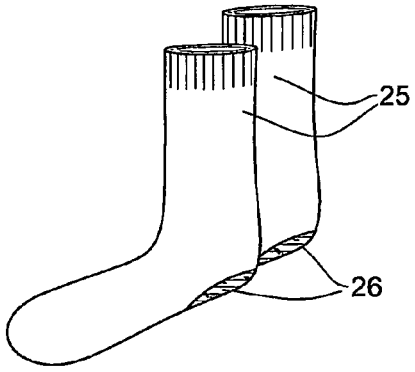
FIG. 2 illustrates a pair of socks according to an embodiment of the present invention.

As seen in FIG. 2, in the event that socks 25 are provided, the heel portion thereof may be provided with a first part 26 of a fastening arrangement, a second part of the fastening arrangement may be located on the article 10, such that when a user is wearing the socks and the two of the articles as slippers, on each foot, the two parts of the fastening arrangements are aligned, so that the articles are retained on the feet of the user. The first part 26 of the fastening arrangement may be located and designed so as to cooperate with the first part 24*a* of the securing arrangement, which would constitute the second part of the fastening arrangement vis-à-vis the socks 25. Alternatively, a distinct second part of the fastening arrangement may be located on the article 10. Furthermore, the location of the parts of the fastening arrangement may be located elsewhere of the sock 25 and the article 26, respectively.

Figure 3A:
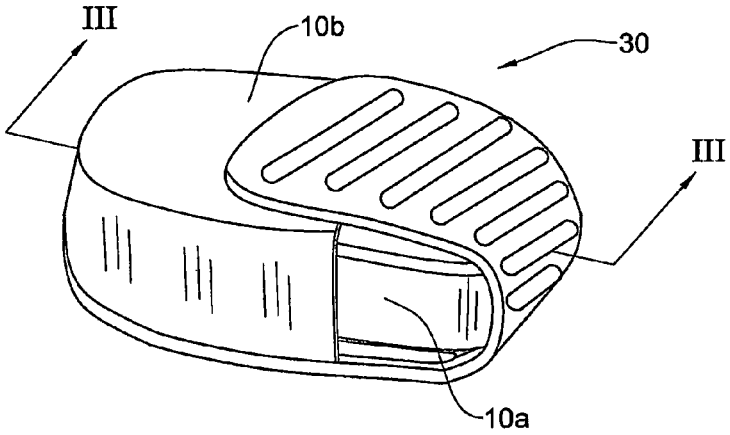
FIG. 3A illustrates a kit according to the present invention.
Figure 3B:
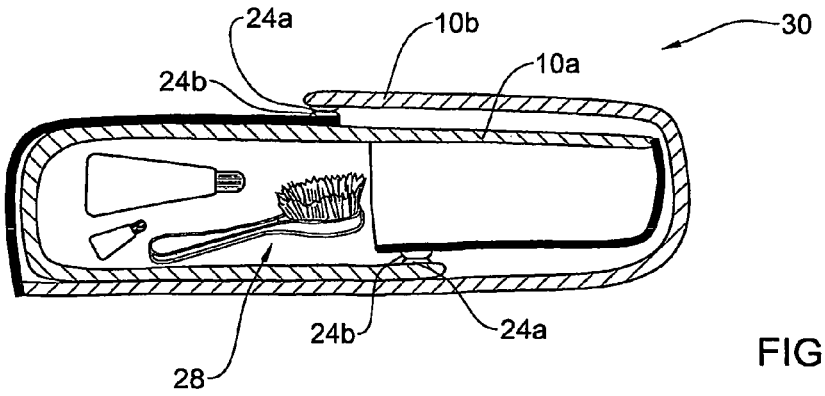
FIG. 3B is a cross-sectional view of the kit illustrated in FIG. 3A, taken along line III-III.

As seen in FIGS. 3A and 3B, the article 10 as described above may be provided as part of a kit, generally indicated at 30, which comprises two of such articles in the closed position. The pouch 12 of a first of the articles 10*a* comprises toiletry items, indicated at 28, such as described above. The first of the articles 10*a*, in its closed position, is then placed inside the pouch 12 of the second of the articles 10*b*, which is closed. Accordingly, the side wall 18 of at least the second of the articles 10*b* should be sizes so that the pouch 12 thereof can accommodate the first of the articles 10*a* in the closed position, with the toiletry items contained therein. A toiletry kit may thus be provided, wherein the storage container for the toiletry items, comprising the first and second of the articles 10*a*, 10*b*, may be opened to form a pair of slippers.

Those skilled in the art to which this invention pertains will readily appreciate that numerous changes, variations and modifications can be made without departing from the scope of the invention mutatis mutandis.

The invention claimed is:

1. A traveler's kit comprising a first traveler's article and a second traveler's article, each article having a primary use associated with an open position thereof, and a secondary use associated with a closed position thereof, the primary use being that of a slipper, the secondary use being that of a storage container, each article comprising:

a pouch defined by a substantially smooth surface, having an opening, and having at least one back wall extending beyond the opening;

the at least one back wall comprises a first part of a securing arrangement near an end which is farthest from the pouch, the pouch comprises a second part of the securing arrangement, the first and second parts of the securing arrangement cooperate together for retaining the article in the closed position, the pouch constitutes, in the open position of the article, a vamp of the slipper, and, in the closed position of the article, a storage pocket, the pouch in the closed position having a closed inner surface and a closed outer surface, and the at least one back wall constitutes, in the open position of the article, a sole of the slipper and, in the closed position of the article, a U-shaped closing flap of the storage container, folded along an axis spaced from the pouch, wherein in a closed configuration of the kit, the first article in the closed position is received inside the pouch of the second article in the closed position so that the closed inner surface of the second article fully conforms with the closed outer surface of the first article, and the pouch of the first article contacts the inner surface of the second article along a substantial portion of the smooth surface thereof.

2. The traveler's article according to claim 1, further comprising toiletry items stored within the pouch.

3. The traveler's article according to claim 2, wherein said toiletry items comprise at least one of a pair of socks, toothpaste, a toothbrush, a collapsible toothbrush, a face-wipe, a shaving kit, mouthwash, hand cream, a facemask, a comb, and earplugs.

4. The traveler's article according to claim 1, wherein said portion of the attachment arrangement is located on an underside of the at least one back wall of the article.

5. The traveler's article according to claim 1, being intended for a single use.

6. A kit comprising two traveler's articles according to claim 1, and at least one toiletry item stored within the pouch of at least one of the articles.

* * * * *